US006059706A

United States Patent [19]

Chehab et al.

[11] Patent Number: 6,059,706

[45] Date of Patent: May 9, 2000

[54] METHOD OF AND APPARATUS FOR TREATING A FILTER TOW

[75] Inventors: Firdausia Chehab, Hamburg; Stefan Fietkau, Westerau; Peter-Franz Arnold, Hamburg, all of Germany

[73] Assignee: Hauni Maschinenbau AG, Hamburg, Germany

[21] Appl. No.: 09/197,671

[22] Filed: Nov. 23, 1998

[30] Foreign Application Priority Data

Nov. 21, 1997 [DE] Germany ..... 197 51 598

[51] Int. Cl.[7] ..... B31C 13/00

[52] U.S. Cl. ..... 493/44; 493/48; 493/50; 131/336

[58] Field of Search ..... 493/44, 42, 46, 493/48, 50, 39; 57/908, 350, 330; 156/150, 441; 131/336

[56] References Cited

U.S. PATENT DOCUMENTS

| | | | |
|---|---|---|---|
| 3,974,007 | 8/1976 | Greve | 156/64 |
| 4,747,814 | 5/1988 | Berger | 493/44 |
| 4,889,139 | 12/1989 | Heitmann | 493/44 |
| 5,106,357 | 4/1992 | Kampen | 493/44 |
| 5,135,008 | 8/1992 | Oesterling et al. | 131/94 |
| 5,203,757 | 4/1993 | Kampen | 493/44 |
| 5,282,779 | 2/1994 | Sakai et al. | 493/44 |
| 5,387,285 | 2/1995 | Rivers | 493/44 |
| 5,725,467 | 3/1998 | Chehab et al. | 493/44 |

FOREIGN PATENT DOCUMENTS

| | | | |
|---|---|---|---|
| 0 269 915 | 6/1988 | European Pat. Off. . | |
| 0 546 519 | 6/1993 | European Pat. Off. . | |
| 2 091 984 | 8/1982 | United Kingdom . | |
| 84 02257 | 6/1984 | WIPO . | |
| WO 88/00440 | 1/1988 | WIPO | 493/44 |

*Primary Examiner*—Peter Vo
*Assistant Examiner*—Matthew Luby
*Attorney, Agent, or Firm*—Venable; George H. Spencer; Robert Kinberg

[57] ABSTRACT

A tow of fibrous filter material for tobacco smoke is transported lengthwise through a so-called finger which is an elongated channel wherein the cross-sectional area of the tow is gradually reduced to that of the rod-like filler in the wrapper of a filter rod. The homogeneity of the tow is enhanced by introducing a compressed gas into longitudinally spaced apart gas admitting portions of the channel and by providing the channel with sets of openings for the evacuation of gas downstream of each gas admitting portion. The channel discharges a continuous homogenized tow into a wrapping mechanism wherein the tow is draped into a web of cigarette paper or the like, and the thus obtained filter rod is severed to yield a file of filter rod sections of unit length or multiple unit length.

25 Claims, 4 Drawing Sheets

METHOD OF AND APPARATUS FOR TREATING A FILTER TOW

CROSS-REFERENCE TO RELATED CASES

This application claims the priority of German patent application Serial No. 197 51 598.3 filed Nov. 21, 1997. The disclosure of the German patent application, as well as that of each patent mentioned in the specification of the present application, is incorporated herein by reference.

BACKGROUND OF THE INVENTION

This invention relates to improvements in methods of and in apparatus for treating tows of fibrous filter material for tobacco smoke, and more particularly to the treatment of filter tows on their way from a source (such as a bale) to one or more stations where the treated tow is draped into a web of suitable wrapping material and the thus obtained filter rod is subdivided into filter rod sections of unit length or multiple unit length. Such filter rod sections can be transported to storage or into the magazine(s) of one or more filter tipping machines wherein the sections are united with plain cigarettes, cigars, cigarillos or other rod-shaped tobacco-containing products to form therewith filter cigarettes, cigars, cigarillos or other filter tipped smokers' products.

It is customary to convey an elongated tow of filter material for tobacco smoke along an elongated path wherein the cross-sectional area of the tow is gradually reduced to that of the rod-like filler of a filter rod, and the thus obtained rod-shaped intermediate product is draped into a continuous web of cigarette paper, artificial cork or other suitable wrapping material to form with the finished wrapper a continuous filter rod. It is also customary to introduce into successive increments of the running tow a suitable fluid, such as compressed air, and to permit or cause the fluid to escape from the tow at a location ahead of the wrapping station. Reference may be had, for example, to the so-called AF filter rod production line which is distributed by the assignee of the present application.

The path wherein the cross-sectional area of the running tow is being reduced is defined, at least in part, by an elongated channel surrounding an elongated passage of diminishing cross-sectional area (as seen in the direction of advancement of the tow toward the wrapping (filter rod forming) and rod subdividing stations. The fluid (normally but not necessarily compressed air) is introduced into the passage by way of a first set of openings, and a second set of openings in the channel serves to permit or effect the evacuation of fluid from the passage for the filter tow.

In addition to or in lieu of compressed air, the tow can be acted upon by carbon dioxide gas and/or steam. The tow normally consists of crimped filamentary synthetic filter material, such as cellulose acetate or the like. The term channel is intended to denote that part of the filter rod making machine or production line which is often called finger and constitutes an elongated tube defining a passage having a cross-sectional area which diminishes in the direction of advancement of successive increments of an elongated filter tow therethrough. As a rule, the cross-sectional area of the passage at the outlet of the channel or finger equals or approximates the cross-sectional area of the rod-like filler (compacted or condensed filter tow) which is ready to be draped into cigarette paper or the like.

A standard apparatus for processing tows of filter material for tobacco smoke is disclosed, for example, in U.S. Pat. No. 5,106,357 granted Apr. 21, 1992 to Kampen for "METHOD AND APPARATUS FOR PRODUCING TOBACCO SMOKE FILTER RODS". This patent discloses the introduction of compressed air into the channel or finger for the purpose of enhancing the homogeneity of the tow, and the thus admitted air is thereupon caused or permitted to escape through the interstices of a substantially sieve-like portion of the channel. It has been found that such treatment of the tow does not invariably result in the making of a high-quality filter for tobacco smoke.

OBJECTS OF THE INVENTION

An object of the invention is to provide a novel and improved method of treating a running tow of filamentary filter material for tobacco smoke.

Another object of the invention is to provide a method which renders it possible to enhance the homogeneity of a tow of filter material for tobacco smoke in a simple, inexpensive and reliable manner.

A further object of the invention is to provide a method which renders it possible to select the extent of homogeneity of a running tow of fibrous filter material for tobacco smoke so that the ultimate homogeneousness at least approximates a maximum achievable degree.

An additional object of the invention is to provide a method which can be practiced in connection with all kinds of presently known fibrous filter materials for tobacco smoke.

Still another object of the invention is to provide a novel and improved apparatus for the practice of the above outlined method.

A further object of the invention is to provide a novel and improved conduit or finger for use in the above outlined apparatus.

Another object of the invention is to provide the improved apparatus with a novel system of components for the introduction of a homogenizing agent into and for the evacuation of such agent from a running tow of fibrous filter material for tobacco smoke.

An additional object of the invention is to provide an apparatus which constitutes a relatively simple and inexpensive but highly effective modification of heretofore known apparatus for making filter rod sections which are ready to be processed in filter tipping machines.

Still another object of the invention is to provide an apparatus which can be combined with or incorporated in existing filter rod making machines or production lines for the making of filter cigarettes or the like as a superior substitute for heretofore known apparatus for treating tows of filter material for tobacco smoke.

A further object of the invention is to provide a novel and improved method of treating a running tow of crimped cellulose acetate fibers or the like between the so-called banding and stretching stations on the one hand and the filter rod making station on the other hand.

Another object of the invention is to provide filter cigarettes, cigars, cigarillos and/or analogous filter tipped smokers' products which employ filter tips or mouthpieces produced in accordance with the above outlined method and by resorting to apparatus which can be utilized for the practice of such method or equivalent methods.

SUMMARY OF THE INVENTION

One feature of the present invention resides in the provision of a novel and improved method of treating an elongated tow or band of fibrous filter material for tobacco smoke, for example, a tow consisting of or containing crimped cellulose acetate fibers. The method comprises the steps of advancing the tow lengthwise in a predetermined direction and along a predetermined path, preferably gradually reducing the cross-sectional area of the tow in an elongated section of the path, introducing a pressurized fluid into the tow in a first portion of the elongated section of the path, evacuating at least a portion of the introduced fluid from the tow in a second portion of the section downstream of the first portion (as seen in the predetermined direction), introducing a pressurized fluid into the tow in a third portion of the elongated section downstream of the second portion, and evacuating at least a portion of the fluid in a fourth portion of the section downstream of the third portion.

The fluid is or can be a gaseous fluid, e.g., air or carbon dioxide. However, it is also possible to resort to a vapor.

At least one of the introducing and evacuating steps can include conveying the fluid through a plurality of openings in a channel or finger bounding the respective portion of the elongated section of the path.

The method can further comprise the step of converting the tow into a rod-like filler of a filter rod in a second section of the path downstream of the elongated section. Such method can comprise the further step of subdividing the filter rod into a series or file of filter rod sections of predetermined (unit or multiple unit) length.

The step of introducing a pressurized fluid into the first portion of the elongated section of the path can include maintaining the fluid at a first pressure, and the step of introducing a pressurized fluid into the third portion of the elongated section of the path can include maintaining such fluid at a second pressure which is different from the first pressure. In accordance with a presently preferred embodiment of the method, the first pressure is higher than the second pressure.

At least one of the aforementioned introducing steps can include conveying pressurized fluid through a plurality of openings which are provided in a channel bounding the respective portion of the elongated section of the path; at least some of these openings are or can be elongated in the predetermined direction.

If at least one of the evacuating steps includes conveying the fluid through a plurality of openings which are provided in a channel bounding the respective portion of the elongated section of the path, at least some of these openings can have at least substantially identical cross-sectional areas.

The method can further comprise the steps of introducing a pressurized fluid into the tow in at least one additional portion of the elongated section downstream of the fourth portion of such section, and evacuating at least some of the fluid from the tow in a further portion of the elongated section downstream of the at least one additional portion.

Another feature of the invention resides in the provision of an apparatus for treating an elongated tow of fibrous filter material for tobacco smoke. The improved apparatus comprises means (e.g., several sets of rolls with each set including at least one driven roll) for advancing the tow lengthwise in a predetermined direction along a predetermined path, a channel bounding an elongated section of the path and defining for the tow a passage of decreasing cross-sectional area (as seen in the predetermined direction) so that successive increments of the advancing tow undergo compression during advancement in the passage of the channel, means for introducing a pressurized fluid into the tow through a first portion of the channel, means for evacuating at least some of the fluid from the tow in a second portion of the channel downstream of the first portion (as seen in the predetermined direction), means for introducing a pressurized fluid into the tow through a third portion of the channel downstream of the second portion, and means for evacuating at least some of the fluid from the tow in a fourth portion of the channel downstream of the third portion.

As already mentioned hereinbefore, the fluid which is being introduced into the running tow is or can be air.

At least one of the introducing and evacuating means can comprise a plurality of openings which are provided in the channel.

The means for introducing a pressurized fluid through the first portion of the channel can include means for supplying the fluid at a first pressure, and the means for introducing a pressurized fluid through the third portion of the channel can include means for supplying the fluid at a second pressure which is different from (preferably lower than) the first pressure. For example, the first pressure can be in the range of 3 bar, and the second pressure can be in the range of 2 bar.

At least one of the introducing and evacuating means can comprise a substantially sieve-like portion of the channel. If at least one of the evacuating means comprises a substantially sieve-like portion of the channel, such sieve-like portion can be provided with openings having similar or identical areas.

At least one of the introducing and evacuating means can comprise at least substantially circular openings provided in the respective portion of the channel. Such openings can have similar or identical diameters, e.g., in the range of between approximately 0.8 mm and approximately 1.2 mm, preferably 1 mm or rather close to 1 mm.

It is also possible to design the introducing means in such a way that at least one thereof comprises a plurality of ports provided in the respective portion of the channel. At least some of the ports can extend at oblique angles to the predetermined direction; for example, at least one of these oblique angles can be less than 90°. At least some of the ports can include slots, and at least some of these slots can be elongated in the predetermined direction.

The apparatus preferably further comprises or cooperates with means for converting the tow into a rod-like filler of a filter rod downstream of the fourth portion of the channel.

Still further, the improved apparatus can comprise means for introducing a pressurized fluid into the tow though a fifth portion of the channel downstream of the fourth portion (as seen in the predetermined direction), and means for evacuating fluid from the tow in a sixth portion of the channel downstream of the fifth portion.

The novel features which are considered as characteristic of the invention are set forth in particular in the appended claims. The improved filter tow treating apparatus itself, however, both as to its construction and the modes of assembling and utilizing the same, together with numerous additional advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
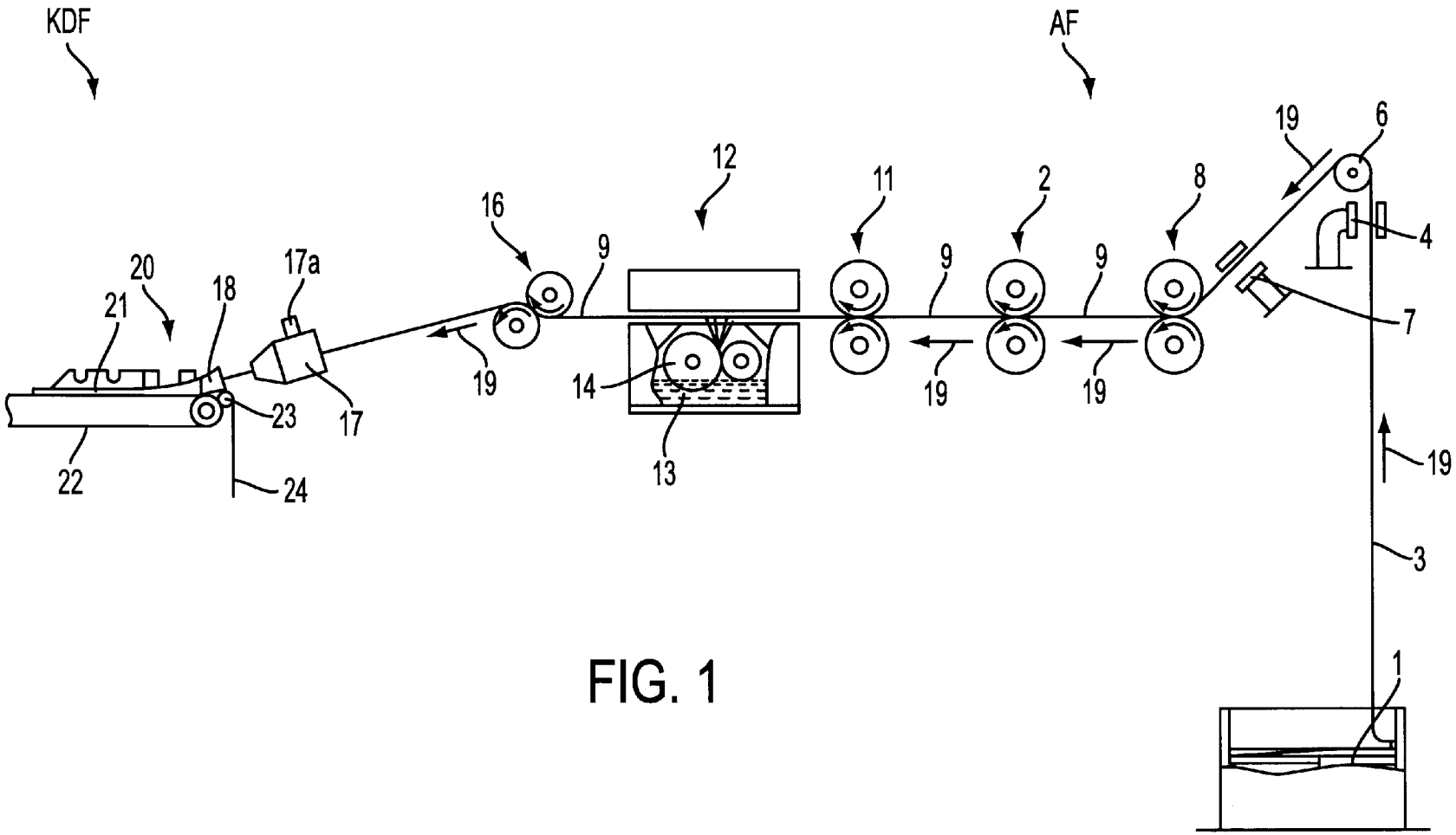
FIG. 1 is a schematic partly elevational and partly sectional view of an apparatus which embodies one form of the invention and wherein the channel in part embodies and in part cooperates with three pairs of fluid introducing and fluid evacuating means.

FIG. 1 shows an apparatus which embodies one form of the invention and comprises a filter tow processing machine AF and a filter rod making machine KDF. The filter tow 3 is drawn from a bale 1 and is advanced along an elongated path in the direction indicated by arrows 19. Not only the machine AF but also the machine KDF is distributed by the assignee of the present application.

Initially, the tow 3 consists of crimped cellulose acetate fibers and is advanced lengthwise by three sets of rolls 2, 11 and 16. Each such set can comprise a positively driven roll having a peripheral surface provided with circumferentially extending grooves, and an idler roll having a peripheral portion or rim made of a resilient material and bearing against the respective grooved (positively driven) roll. The means for transmitting torque to the positively driven rolls of the sets of rolls 2, 11 and 16 can include discrete variable-speed electric motors or other suitable prime movers.

Successive increments of the tow 3 which are drawn by the advancing rolls 2 in the direction of the arrows 19 are caused to move through the gap between a plate and a compressed air nozzle of a so-called banding device 4 which serves to loosen or open the filaments of the advancing tow. The latter is trained over a deflecting roller 6 prior to advancing through the gap between the plate and the compressed air nozzle of a second banding device 7 and thereupon through the nip of two idler rollers or braking rollers 8 which are rotated by the advancing tow. A somewhat similar arrangement is disclosed in U.S. Pat. No. 3,974,007 granted Aug. 10, 1976 to Greve for "METHOD AND APPARATUS FOR THE PRODUCTION OF FILTER ROD SECTIONS OR THE LIKE".

The partially treated tow 9 which advances beyond the idler (braking) rollers 8 resembles a flat layer having at least substantially parallel (i.e., at least partially uncrimped) filaments because the advancing rolls 2 are caused to pull and to thus stretch the filaments. The stretching action is or can be even more pronounced between the advancing rolls 2, 11 because the peripheral speeds of the rolls 11 normally exceed those of the rolls 2.

The thus obtained partially treated tow 9 is caused to advance through an applicator 12 wherein a driven rotary brush 14 propels droplets of a suitable plasticizer 13 (such as triacetin) against the underside of the advancing tow 9. The droplets of plasticizer bond portions of neighboring filaments to each other; this enables the finished filter mouthpieces to establish mazes of paths for the flow of tobacco smoke from the lighted end of a filter cigarette or another filter tipped smokers' product into the mouth of a smoker.

The driven rolls 16 draw the plasticizer-carrying tow 9 from the applicator 12 and further serve to change the direction of forward movement of the tow, namely into the inlet of a nozzle 17 which defines a path wherein the flat or practically flat tow 9 is converted into an at least substantially rod-like tow and is contacted by a pressurized gaseous fluid (e.g., compressed air) which is supplied by an inlet 17*a*. The substantially rod-shaped tow which issues from the passage defined by the nozzle 17 is relieved of compressed air before and while it passes through a so-called gathering horn 18 into an elongated passage defined by a channel 21 at a wrapping station 20.

The character 24 denotes an elongated web of cigarette paper, imitation cork or other suitable wrapping material which is drawn off a reel by an endless belt conveyor 22 (known as garniture) and is trained over a deflecting roller 23.

The upper reach of the belt conveyor 22 is not flat; its marginal portions are gradually folded upwardly to convert the web 24 into a tube one marginal portion of which is coated with an adhesive and is thereupon folded over and caused to adhere to the other marginal portion. This completes the conversion of the web 24 into a tube which surrounds a rod-like filler (converted tow 9) of filter material to form therewith a continuous filter rod which is severed by a suitable cutoff to yield a series or file of filter rod sections of unit length or multiple unit length. The filter rod sections are transported into the magazine of a filter tipping machine (KDF) wherein such sections are united with plain cigarettes, cigars, cigarillos or the like to form therewith filter cigarettes, cigars, etc. of unit length or multiple unit length. Reference may be had, for example, to commonly owned U.S. Pat. No. 5,135,008 granted Aug. 4, 1992 to Oesterling et al. for "METHOD OF AND APPARATUS FOR MAKING FILTER CIGARETTES". A wrapping mechanism and a cutoff are disclosed and shown in the aforementioned U.S. Pat. No. 3,974,007 to Greve.

The cross-sectional area of the elongated path which is defined by the channel 21 decreases in the direction of the arrows 19 (see FIG. 2) so that the tow 9 undergoes a progressive compacting or gathering action and its cross-sectional area ultimately matches or at least approximates the cross-sectional area of the rod-like filler in the finished filter rod.

Figure 2A:
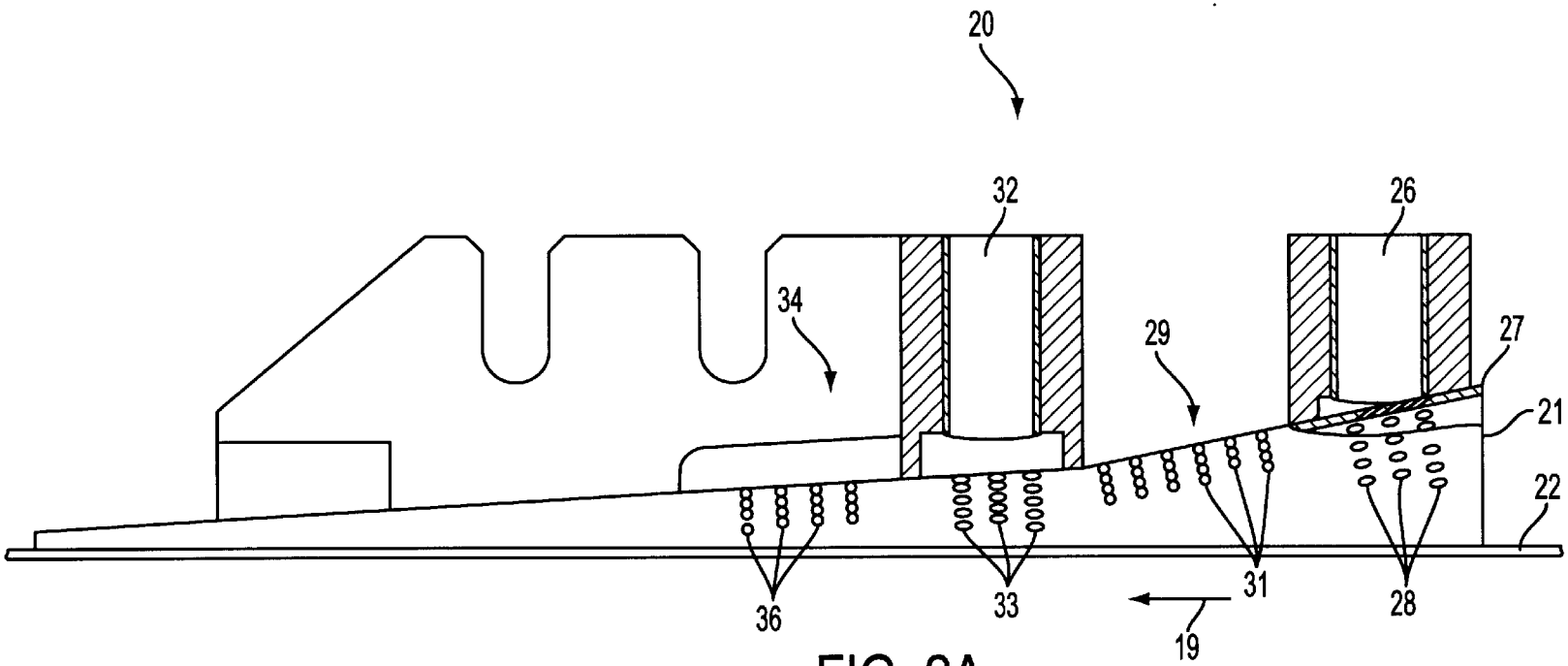
FIG. 2*a* is an enlarged view of a detail in the structure which is shown in FIG. 2.
Figure 2B:
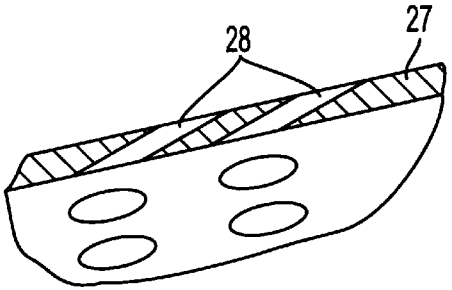
FIG. 2 is an enlarged fragmentary partly elevational and partly longitudinal vertical sectional view of the channel in the apparatus of FIG. 1.
Figure 3:
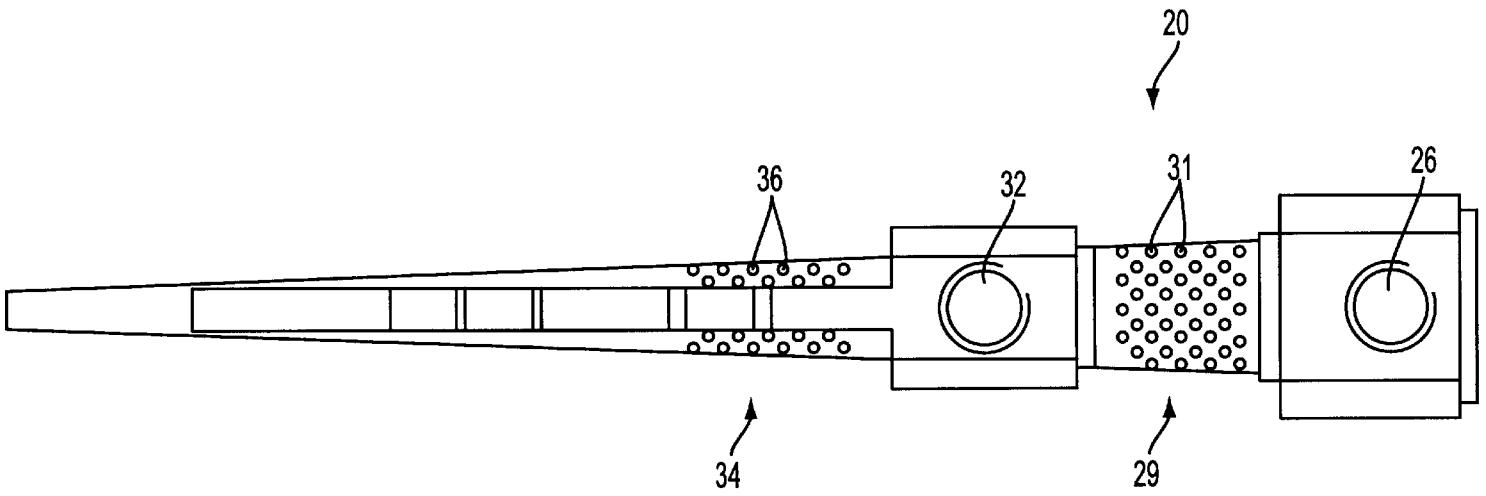
FIG. 3 is a top plan view of the structure which is shown in FIG. 2 but with a belt conveyor omitted.
Figure 4:
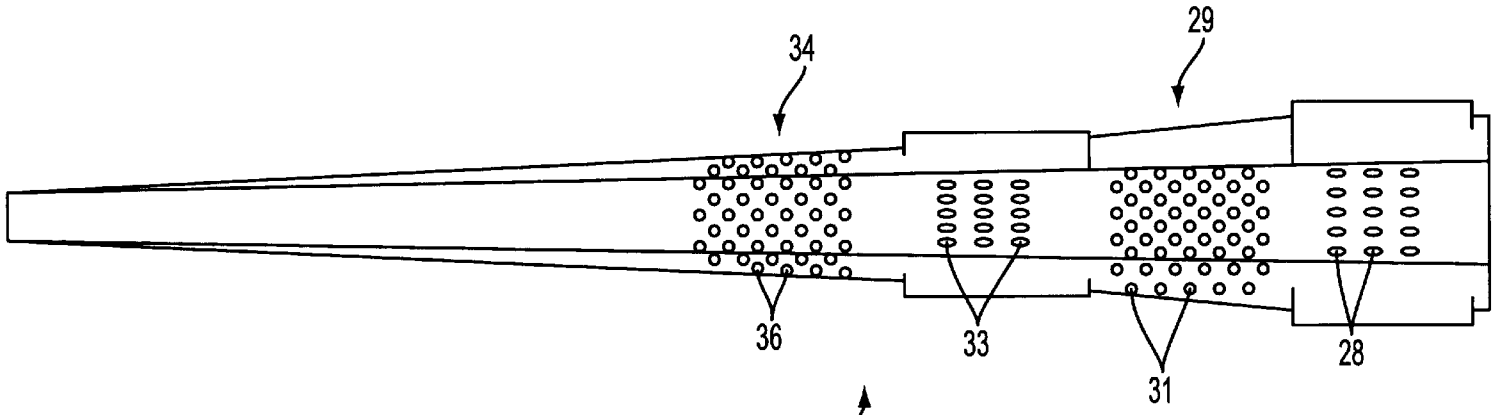
FIG. 4 is a bottom plan view of the structure which is shown in FIG. 3.

FIGS. 2, 2*a*, 3 and 4 illustrate the details of the means for repeatedly introducing a pressurized fluid (such as compressed air) into and for repeatedly evacuating fluid from longitudinally spaced apart portions of that elongated section of the path for the pretreated tow 9 which is defined by the channel or finger 21. FIG. 2 further shows a portion of the upper reach or stretch of the endless belt conveyor (garniture) 22 which draws the web 24 of wrapping material and successive increments of the tow 9 in the direction of the arrows 19 and lengthwise through the elongated section of the path. Such elongated section is followed by a second section wherein the freshly formed filter rod is subdivided into a file of filter rod sections (e.g., into sections of double unit length as disclosed in U.S. Pat. No. 5,135,008 to Oesterling et al.) which are united with pairs of plain cigarettes or the like of unit length to form filter cigarettes or the like of double unit length. The manner in which one marginal portion of the web 24 is provided with a film of adhesive and the web is converted into a tubular envelope of the thus obtained filter rod is disclosed in the aforementioned U.S. Pat. No. 3,974,007 to Greve.

The cross-sectional area of the passage which is defined by the channel 21 at the wrapping station 20 decreases more or less gradually in a direction away from the nozzle 17 and extends longitudinally of the upper reach of the belt conveyor 22. As already mentioned above, the conveyor 22 has marginal portions which are caused to flex upwardly to thus compel the respective marginal portions of the running web 24 to bend upwardly, i.e., the web 24 is caused to gradually confine the adjacent portions of the tow 9 and its marginal portions are then caused to overlie and adhere to each other in a manner as known from the art of cigarette and filter rod making machines.

The first means for introducing a pressurized fluid (normally compressed air) into the tow 9 within the channel 21 includes an inlet 26 which receives compressed air from a suitable source (and which can form part of such source), and a sieve-like portion with elongated openings or ports 28 in the wall 27 of the channel 21 (see also FIG. 2*a*). The ports 28 are elongated in the direction indicated by the arrows 19 and form several rows extending transversely of the longitudinal direction of the channel 21. For example, the pressure of air which is being admitted via inlet 26 and openings or ports 28 can be in the range of 3 bar. The streamlets of compressed air which are caused to flow from the inlet 26, through the ports 28 and into the passage defined by the channel 21 cause the filaments in successive increments of the tow 9 to move relative to each other and to become interlaced; this is desirable because such orientation or reorientation of filaments enhances the resistance of the respective filter plugs or filter mouthpieces to the flow of tobacco smoke from the lighted end of a filter cigarette or the like into a smoker's mouth.

The oblique angles at which the streamlets of compressed air flow from the inlet 26, through the forwardly inclined openings or ports 28 and into the adjacent portion of the advancing tow 9 can be in the range of between about 10° and 30°, e.g., approximately 20°. Such inclination of the streamlets of compressed air is desirable on the ground that the inflowing compressed air enhances the advancing action of the upper reach of the belt conveyor 22, i.e., the body of compressed air being admitted via inlet 26 tends to advance the tow 9 in the direction indicated by the arrows 19.

The air admitting means 26, 28 is followed by a sieve-like air evacuating portion 29 in the wall 27 of the channel 21. The portion 29 includes several transversely extending rows of at least substantially circular openings or ports 31. The diameters of such circular openings or ports 31 can be in the range of between about 0.5 and 1.5 mm, e.g., between 0.8 and 1.2 mm (preferably at least close to 1 mm). It is clear that the dimensions and/or the configurations of the openings 28 and/or 31 (and/or of the openings or ports to be described hereinafter) can depart from the aforementioned dimensions and/or configurations without departing from the spirit of the instant invention.

A second compressed air admitting portion of the improved apparatus comprises an inlet 32 which receives compressed air from a suitable source (e.g., from the source (such as a pump or an accumulator) which supplies compressed air to the inlet 26 and/or to the inlet 17*a*) and a set of elongated openings or ports 33 in the wall 27 of the channel 21. The openings or ports 33 may but need not be identical with the openings or ports 28. The pressure of air being supplied by the inlet 32 (e.g., about 2 bar) is or can be less than that of air being supplied by the inlet 26. For example, the conduits (not shown) which connect the inlets 17*a*, 26 and 32 with a common source of compressed air or with discrete sources can contain suitable pressure regulating valves which render it possible to adjust the pressure of air flowing into the inlet 17*a* independently of the pressure of air flowing into the inlet 26 and/or 32 and vice versa.

The action of streamlets of compressed air entering the passage of the channel 21 by way of the rows of openings or ports 33 is analogous to that of the streamlets entering via openings or ports 28, i.e., the filaments of the tow become further interlaced to thus enhance the homogeneousness of the tow for a second time (within the confines of the channel 21) with attendant pronounced enhancement of the filtering quality of the tow which is about to be converted into the rod-like filler of a filter rod. The inclination of streamlets of compressed air entering the tow 9 via openings or ports 33 (relative to the direction of advancement of the tow 9) is or can be the same as (or close to) that of the streamlets of compressed air being admitted via openings or ports 28.

The means for evacuating at least some of the compressed air being supplied by the inlet 32 includes a sieve-like portion 34 of the wall 27. The portion 34 has circular or substantially circular openings or ports 36 which can be dimensioned and distributed in the same way (or in a similar way) as the openings or ports 31.

An advantage of relatively small openings 31 and 36 is that they are less likely to permit entry or escape of filaments or fragments of filaments forming part of the advancing tow 9. The pressure of air which is being admitted via inlet 26 and/or 32 can be selected in dependency upon the dimensions and/or the combined number of the openings 31 and/or 36 as well as in dependency upon one or more additional parameters, such as the desired extent of homogenization of the tow 9.

If the nozzle 17 of FIG. 1 is considered as a constituent of a composite channel which further includes the elongated channel or finger 21 of FIGS. 2, 2*a*, 3 and 4, the improved apparatus can be said to comprise three devices (17*a*; 26,28; 32,33) for the introduction or admission of a pressurized fluid into the advancing tow 9, and three devices for evacuation of such fluid (namely the path portion between the nozzle 17 and the horn 18; the device 29; and the device 34). The fluid introducing devices alternate with the fluid evacuating devices (as seen in the direction indicated by the arrows 19).

Figure 5:
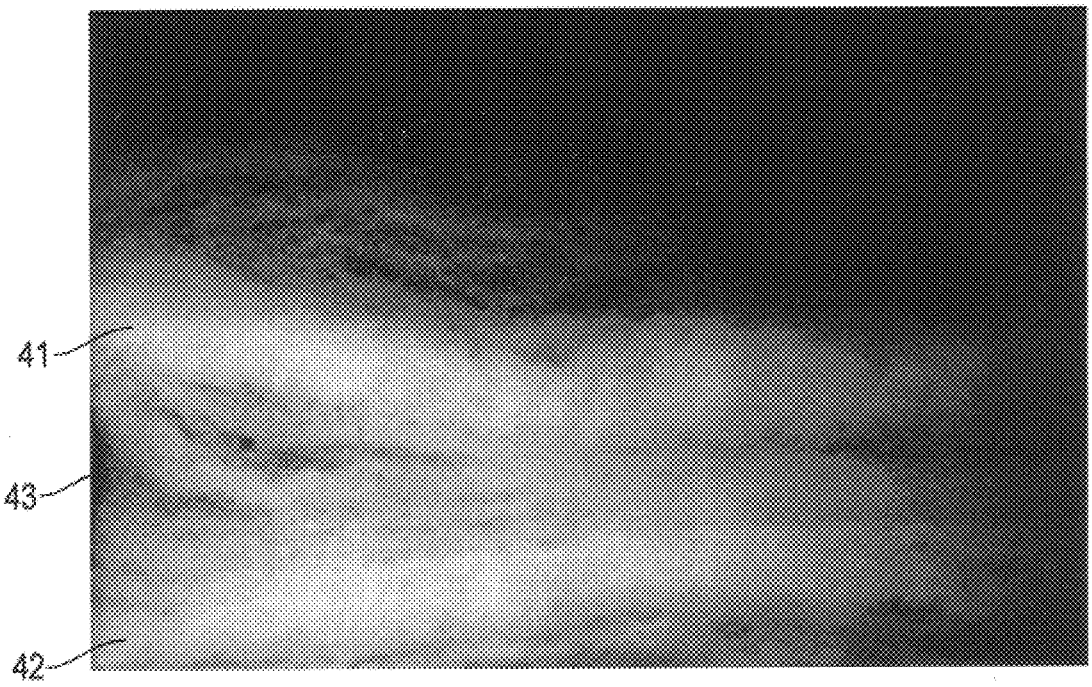
FIG. 5 (PRIOR ART)
FIG. 5 is an enlarged photograph of a portion of a filter tow which has been treated in accordance with the teaching in U.S. Pat. No. 5,106,357 to Kampen.

The photograph of FIG. 5 shows the distribution of filaments in a filter tow which has been processed in accordance with the teaching of the U.S. Pat. No. 5,106,357 to Kampen. The reference characters 41 and 42 denote two discrete densified zones which are present in the filler upon opening of the tubular envelope of the respective portion of the filter rod. A zone or region 43 between the zones 41 and 42 contains filaments which have undergone a much less pronounced densification, i.e., the number of filaments per unit volume of the zone 43 is much less than in the zone 41 and/or 42. This affects the quality of the rod-like filler.

Figure 6:
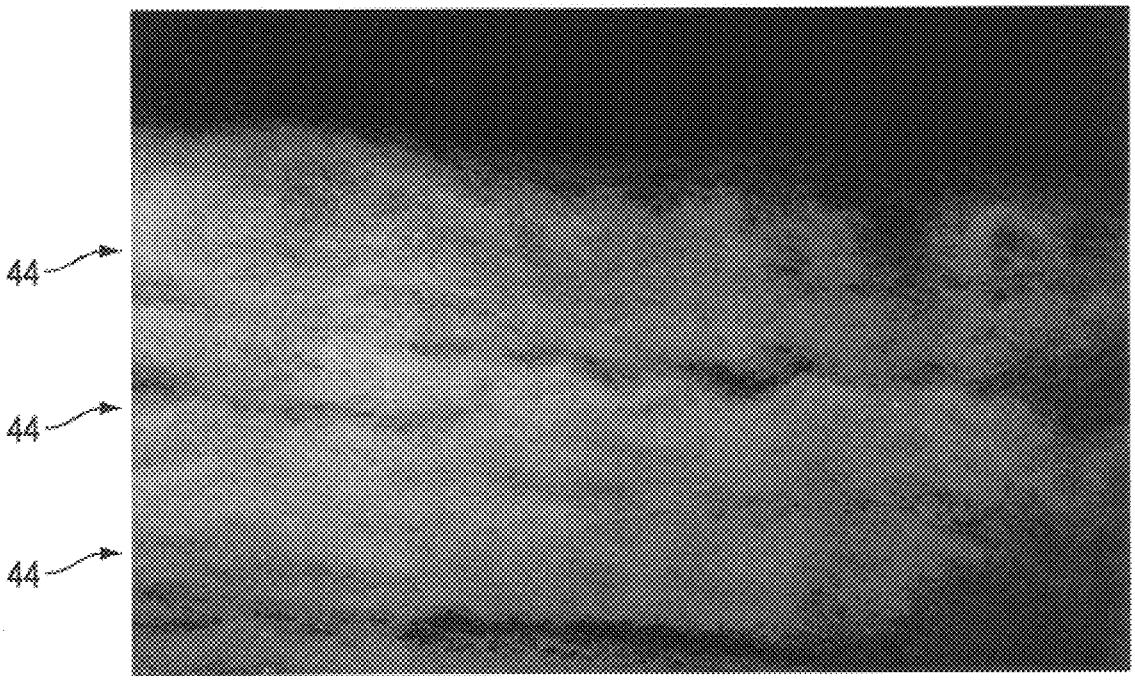
FIG. 6 is an enlarged photograph of a portion of a filter tow which has been treated in accordance with the method of and in the apparatus of the present invention.

FIG. 6 shows a portion of the filler 44 in a filter rod which has been treated in accordance with the method and in the apparatus of the present invention. It will be seen that the distribution of filaments is quite uniform in each and every portion of the filer; this enhances the tobacco smoke filtering action of the ultimate products.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of treating tows of filter material for tobacco smoke and, therefore, such adaptations should and are intended to be comprehended within the meaning and range of equivalence of the appended claims.

What is claimed is:

1. A method of treating an elongated tow of fibrous filter material for tobacco smoke, comprising the steps of:

advancing the tow lengthwise in a predetermined direction along a predetermined path;

reducing the cross-sectional area of the tow along the length of a section of said path;

introducing a first pressurized fluid into the tow in a first portion of said section, said introducing step including the sub-step of maintaining said first pressurized fluid at a first pressure;

evacuating at least a portion of the introduced fluid from the tow in a second portion of the said section of said path, said second portion being located downstream of said first portion, as defined by said predetermined direction;

introducing a second pressurized fluid, which is the same as or different from said first pressurized fluid, into the tow in a third portion of said section, said third portion being located downstream of said second portion, said step of introducing a second pressurized fluid including the sub-step of maintaining the second pressurized fluid at a second pressure less than said first pressure; and evacuating at least a portion of fluid from the tow in a fourth portion of said section, said fourth portion being located downstream of said third portion, wherein each of said steps of introducing a pressurized fluid introduces the respective pressurized fluid into the tow at an angle of 90 degrees or less with respect to said predetermined direction.

2. The method of claim 1, wherein at least one of said first and second pressurized fluids is a gaseous fluid.

3. The method of claim 1, wherein at least one of said first and second pressurized fluids is air.

4. The method of claim 1, wherein at least one of said introducing and evacuating steps includes conveying fluid through a plurality of openings in a channel bounding the respective portion of said section.

5. The method of claim 1, further comprising the step of converting the tow into an elongated filler of a filter rod in a second section of said path located downstream of said section of said path.

6. The method of claim 5, further comprising the step of subdividing the filter rod into a series of filter rod sections of predetermined length.

7. The method of claim 1, wherein at least one of said introducing steps includes conveying pressurized fluid through a plurality of openings which are provided in a channel bounding the respective portion of said section and at least some of which are elongated in said predetermined direction.

8. The method of claim 1, wherein at least one of said evacuating steps includes conveying fluid through a plurality of openings provided in a channel bounding the respective portion of said section, at least some of said openings having at least substantially identical cross-sectional areas.

9. A method of treating an elongated tow of fibrous filter material for tobacco smoke, comprising the steps of:

advancing the tow lengthwise in a predetermined direction along a predetermined path;

reducing the cross-sectional area of the tow along the length of a section of said path;

introducing a first pressurized fluid into the tow in a first portion of said section, said introducing step including the sub-step of maintaining said first pressurized fluid at a first pressure;

evacuating at least a portion of the introduced fluid from the tow in a second portion of the said section of said path, said section portion being located downstream of said first portion, as defined by said predetermined direction;

introducing a second pressurized fluid, which is the same as or different from said first pressurized fluid, into the tow in a third portion of said section, said third portion being located downstream of said second portion;

evacuating at least a portion of fluid from the tow in a fourth portion of said section, said fourth portion being located downstream of said third portion;

introducing a third pressurized fluid, which may be the same as or different from either or both of said first and second pressurized fluids, into the tow in at least one additional portion of said section, said additional portion located downstream of said fourth portion; and evacuating fluid from the tow in a further portion of said section, said further portion located downstream of said at least one additional portion, wherein each of said steps of introducing a pressurized fluid introduces the respective pressurized fluid into the tow at an angle of 90 degrees or less with respect to said predetermined direction.

10. Apparatus for treating an elongated tow of fibrous filter material for tobacco smoke, comprising:

means for advancing the tow lengthwise in a predetermined direction along a predetermined path;

a channel bounding a lengthwise section of said path and defining for the tow a passage of decreasing cross-sectional area, which cross-sectional area decreases as said channel is traversed in said predetermined direction, so that successive increments of the advancing tow undergo compression during advancement in said passage;

means for introducing a first pressurized fluid into the tow through a first portion of said channel, said means for introducing including means for supplying said first pressurized fluid at a first pressure;

means for evacuating fluid from the tow in a second portion of said channel, said second portion located downstream of said first portion as defined by said predetermined direction;

means for introducing a second pressurized fluid, which is the same as or different from said first pressurized fluid, through a third portion of said channel, said third portion located downstream of said second portion, said means for introducing including means for supplying said second pressurized fluid at a second pressure lower than said first pressure; and means for evacuating fluid from the tow in a fourth portion of said channel, said fourth portion located downstream of said third portion, wherein each of said means for introducing introduces its respective pressurized fluid into the tow at an angle of 90 degrees or less with respect to said predetermined direction.

11. The apparatus of claim 10, wherein at least one of said pressurized fluids is air.

12. The apparatus of claim 10, wherein at least one of said introducing and evacuating means comprises a plurality of openings provided in said channel.

13. The apparatus of claim 10, wherein at least one of said introducing and evacuating means comprises a substantially sieved portion of said channel.

14. The apparatus of claim 10, wherein at least one of said evacuating means comprises a substantially sieved portion of said channel, said sieve-like portion being provided with openings having similar or identical areas.

15. The apparatus of claim 10, wherein at least one of said introducing and evacuating means comprises substantially circular openings provided in the respective portion of said channel.

16. The apparatus of claim 15, wherein said openings have similar or identical diameters.

17. The apparatus of claim 15, wherein said openings have diameters in the range of between approximately 0.8 mm and approximately 1.2 mm.

18. The apparatus of claim 17, wherein said diameters at least approximate 1 mm.

19. The apparatus of claim 10, wherein at least one of said introducing means comprises a plurality of ports provided in the respective portion of said channel.

20. The apparatus of claim 19, wherein at least some of said ports extend at oblique angles to said predetermined direction.

21. The apparatus of claim 20, wherein at least one of said angles is less than 90°.

22. The apparatus of claim 19, wherein at least some of said ports include slots at least some of which are elongated in said predetermined direction.

23. The apparatus of claim 10, further comprising means for converting the tow into an elongated filler of a filter rod, said means for converting being located downstream of said fourth portion of said channel.

24. Apparatus for treating an elongated tow of fibrous filter material for tobacco smoke, comprising:

means for advancing the tow lengthwise in a predetermined direction along a predetermined path;

a channel bounding a lengthwise section of said path and defining for the tow a passage of decreasing cross-sectional area, which cross-sectional area decreases as said channel is traversed in said predetermined direction, so that successive increments of the advancing tow undergo compression during advancement in said passage;

means for introducing a first pressurized fluid into the tow through a first portion of said channel, said means for introducing including means for supplying said first pressurized fluid at a first pressure in the range of 3 bar;

means for evacuating fluid from the tow in a second portion of said channel, said second portion located downstream of said first portion as defined by said predetermined direction;

means for introducing a second pressurized fluid, which is the same as or different from said first pressurized fluid, through a third portion of said channel, said third portion located downstream of said second portion, said means for introducing including means for supplying said second pressurized fluid at a second pressure in the range of 2 bar; and means for evacuating fluid from the tow in a fourth portion of said channel, said fourth portion located downstream of said third portion, wherein each of said means for introducing introduces its respective pressurized fluid into the tow at an angle of 90 degrees or less with respect to said predetermined direction.

25. Apparatus for treating an elongated tow of fibrous filter material for tobacco smoke, comprising:

means for advancing the tow lengthwise in a predetermined direction along a predetermined path;

a channel bounding a lengthwise section of said path and defining for the tow a passage of decreasing cross-sectional area, which cross-sectional area decreases as said channel is traversed in said predetermined direction, so that successive increments of the advancing tow undergo compression during advancement in said passage;

means for introducing a first pressurized fluid into the tow through a first portion of said channel;

means for evacuating fluid from the tow in a second portion of said channel, said second portion located downstream of said first portion as defined by said predetermined direction;

means for introducing a second pressurized fluid, which is the same as or different from said first pressurized fluid, through a third portion of said channel, said third portion located downstream of said second portion;

means for evacuating fluid from the tow in a fourth portion of said channel, said fourth portion located downstream of said third portion;

means for introducing a third pressurized fluid, which is the same as or different from either or both of said first and second pressurized fluids, into the tow through a fifth portion of said channel, said fifth portion being located downstream of said fourth portion; and means for evacuating fluid from the tow in a sixth portion of said channel, said sixth portion being located downstream of said fifth portion, wherein each of said means for introducing introduces its respective pressurized fluid into the tow at an angle of 90 degrees or less with respect to said predetermined direction.

* * * * *